US008020630B2

(12) United States Patent
Amend et al.

(10) Patent No.: US 8,020,630 B2
(45) Date of Patent: Sep. 20, 2011

(54) SWINGING WEIGHT ASSEMBLY FOR IMPACT TOOL

(75) Inventors: Ryan S. Amend, Easton, PA (US); Kyle D. Grim, Bethlehem, PA (US); Patrick Livingston, Easton, PA (US); Richard J. Bookhout, Nazareth, PA (US)

(73) Assignee: Ingersoll Rand Company, Montvale, NJ (US)

( * ) Notice: Subject to any disclaimer, the term of this patent is extended or adjusted under 35 U.S.C. 154(b) by 159 days.

(21) Appl. No.: 12/553,370

(22) Filed: Sep. 3, 2009

(65) Prior Publication Data

US 2010/0300716 A1 Dec. 2, 2010

Related U.S. Application Data

(60) Provisional application No. 61/182,514, filed on May 29, 2009.

(51) Int. Cl.
*B25D 15/00* (2006.01)

(52) U.S. Cl. ..... 173/93; 173/109; 173/1

(58) Field of Classification Search ..... 173/109, 173/93, 90, 91, 1
See application file for complete search history.

(56) References Cited

U.S. PATENT DOCUMENTS

| | | | | |
|---|---|---|---|---|
| 3,352,368 | A | 11/1967 | Maffey, Jr. | |
| 3,661,217 | A * | 5/1972 | Maurer | 173/93.5 |
| D256,980 | S | 9/1980 | Adams et al. | |
| 4,867,250 | A * | 9/1989 | Ono | 173/93 |
| D339,726 | S | 9/1993 | Bruno et al. | |
| 5,293,747 | A | 3/1994 | Geiger | |
| 5,346,024 | A | 9/1994 | Geiger et al. | |
| D388,678 | S | 1/1998 | Bantly et al. | |
| D393,580 | S | 4/1998 | Bantly et al. | |
| D400,771 | S | 11/1998 | Smith et al. | |
| D403,564 | S | 1/1999 | Izumisawa | |
| 5,906,244 | A | 5/1999 | Thompson et al. | |
| 6,047,779 | A | 4/2000 | Wallace | |
| D434,297 | S | 11/2000 | Iritani et al. | |
| D434,958 | S | 12/2000 | Izumisawa | |
| 6,158,459 | A | 12/2000 | Chang | |
| D436,818 | S | 1/2001 | Izumisawa | |
| D437,760 | S | 2/2001 | Izumisawa | |
| D441,628 | S | 5/2001 | Bass et al. | |

(Continued)

FOREIGN PATENT DOCUMENTS

JP 2001198853 7/2001

OTHER PUBLICATIONS

PCT/US2010/033735, International Search Report and Written Opinion, dated Jan. 28, 2011, (6 pages).

(Continued)

*Primary Examiner* — Brian D Nash
(74) *Attorney, Agent, or Firm* — Michael Best & Friedrich LLP

(57) ABSTRACT

A swinging weight assembly for an impact tool includes an anvil having an impact jaw that is reinforced with a circumferential flange. A hammer includes a hammer lug and a cam lug for pivoting the hammer between an engaged position in which the hammer lug strikes the impact jaw and a disengaged position in which the hammer moves past the impact jaw. The cam lug is separated from the cam lug to define a space in which the reinforcing flange is received.

20 Claims, 8 Drawing Sheets

U.S. PATENT DOCUMENTS

| | | | |
|---|---|---|---|
| 6,338,389 | B1 | 1/2002 | Chang |
| D454,475 | S | 3/2002 | Taga |
| D458,824 | S | 6/2002 | Chen |
| D461,110 | S | 8/2002 | Izumisawa |
| D465,982 | S | 11/2002 | Taga |
| 6,491,111 | B1 | 12/2002 | Livingston et al. |
| D469,673 | S | 2/2003 | Sliker et al. |
| D472,782 | S | 4/2003 | Pusateri et al. |
| 6,561,284 | B2 | 5/2003 | Taga |
| D476,210 | S | 6/2003 | Chen |
| D477,512 | S | 7/2003 | Liu et al. |
| 6,708,779 | B2 | 3/2004 | Taga |
| 6,782,956 | B1 | 8/2004 | Seith et al. |
| D496,243 | S | 9/2004 | Huang |
| D497,529 | S | 10/2004 | Price |
| D497,787 | S | 11/2004 | Liao |
| 6,863,134 | B2 | 3/2005 | Seith et al. |
| 6,883,619 | B1 | 4/2005 | Huang |
| 6,889,778 | B2 | 5/2005 | Colangelo, III et al. |
| D519,807 | S | 5/2006 | Chen |
| D521,339 | S | 5/2006 | Chen |
| D534,047 | S | 12/2006 | Chi |
| D535,536 | S | 1/2007 | Ghode et al. |
| 7,174,971 | B1 | 2/2007 | Chen |
| 7,191,849 | B2 | 3/2007 | Chen |
| D540,134 | S | 4/2007 | Clay |
| D540,640 | S | 4/2007 | Clay |
| 7,311,155 | B2 | 12/2007 | Chang |
| D572,991 | S | 7/2008 | Chen |
| D590,226 | S | 4/2009 | Chu |
| D590,680 | S | 4/2009 | Cole et al. |
| D590,681 | S | 4/2009 | Palermo et al. |
| D591,127 | S | 4/2009 | Taga |
| D610,888 | S | 3/2010 | Izumisawa et al. |
| 2003/0075348 | A1* | 4/2003 | Eardley et al. ..... 173/169 |
| 2004/0177980 | A1 | 9/2004 | Lucas |
| 2005/0161243 | A1 | 7/2005 | Livingston et al. |
| 2006/0090914 | A1 | 5/2006 | Lin et al. |
| 2007/0000674 | A1* | 1/2007 | Sell et al. ..... 173/48 |
| 2007/0289760 | A1 | 12/2007 | Sterling et al. |
| 2008/0066937 | A1 | 3/2008 | Kobayashi |
| 2009/0038816 | A1 | 2/2009 | Johnson et al. |

OTHER PUBLICATIONS

Photographs of pneumatic tools, publicly available prior to Apr. 18, 2006.

* cited by examiner

SWINGING WEIGHT ASSEMBLY FOR IMPACT TOOL

RELATED APPLICATIONS

This application claims priority to U.S. Patent Application No. 61/182,514 filed May 29, 2009, the entire contents of which are incorporated herein.

BACKGROUND

The present invention relates to a swinging weight assembly which may be incorporated into an impact tool.

SUMMARY

In one embodiment, the invention provides an impact mechanism comprising: a hammer defining a hammer axis and including a hammer lug, a cam lug spaced from the hammer lug, and a recess between the hammer lug and cam lug; an anvil defining an anvil axis that is generally parallel to but non-collinear with the hammer axis, the anvil including a jaw extending substantially parallel to the anvil axis, an engaging cam surface, and a flange generally perpendicular to the anvil axis and interconnected with the jaw; and a connector adapted to mount to a motor output shaft and rotate in response to rotation of the motor output shaft, the connector including a disengaging cam surface bearing against the cam lug to cause the hammer to orbit the anvil in response to rotation of the connector; wherein a portion of the flange is received within the arcuate recess of the hammer between the hammer lug and the cam lug for at least a portion of the orbital movement of the hammer about the anvil; wherein the hammer is pivoted about the hammer axis into an engaged position in response to a portion of the hammer moving along the engaging cam surface of the anvil, the hammer lug striking the jaw of the anvil when the hammer lug is in the engaged position and the hammer is moving at a rate in excess of a critical speed, the hammer lug striking the jaw causing rotation of the anvil about the anvil axis; and wherein the hammer is pivoted about the hammer axis into a disengaged position prior to the hammer striking the jaw of the anvil in response to the disengaging surface of the connector bearing against the cam lug while the hammer is moving at a rate below a critical speed, such that the hammer lug moves past the jaw of the anvil.

The impact mechanism may further comprise a housing supporting the hammer for pivotal movement between the engaged and disengaged positions; wherein the housing is rotatable about the anvil axis as the hammer orbits the anvil. In some embodiments, the hammer lug is a first hammer lug; wherein the hammer further includes a second hammer lug; wherein the jaw of the anvil is a first jaw and the engaging cam surface of the anvil is a first engaging cam surface; wherein the anvil further includes a second jaw and a second engaging cam surface; wherein movement of the second hammer lug along the first engaging cam surface causes the hammer to pivot into a first engaged position to strike the first jaw when the hammer orbits about the axis in a first direction; and wherein movement of the first hammer lug along the second engaging cam surface causes the hammer to pivot into a second engaged position to strike the second jaw when the hammer orbits about the axis in a second direction opposite the first direction. In some embodiments, the jaw of the anvil is a first jaw, the anvil further including a second jaw generally parallel to the first jaw; wherein the flange is interconnected to both the first and second jaws. In some embodiments, the jaw of the anvil includes first and second opposite ends; wherein the flange is a first flange that is interconnected with the first end of the anvil; and wherein the hammer further includes a second flange generally perpendicular to the anvil axis and interconnected with the second end of the jaw. In some embodiments, the jaw of the anvil is a first jaw, the anvil further including a second jaw generally parallel to the first jaw; wherein both the first jaw and the second jaw each include first and second opposite ends; and wherein the flange is a first flange interconnected with the first ends of the first and second jaws, the anvil further comprising a second flange generally parallel to the first flange and interconnected to the second ends of the first and second jaws. In some embodiments, the flange is generally ring shaped and is within the arcuate recess of the hammer during substantially an entire orbit of the hammer around the anvil.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
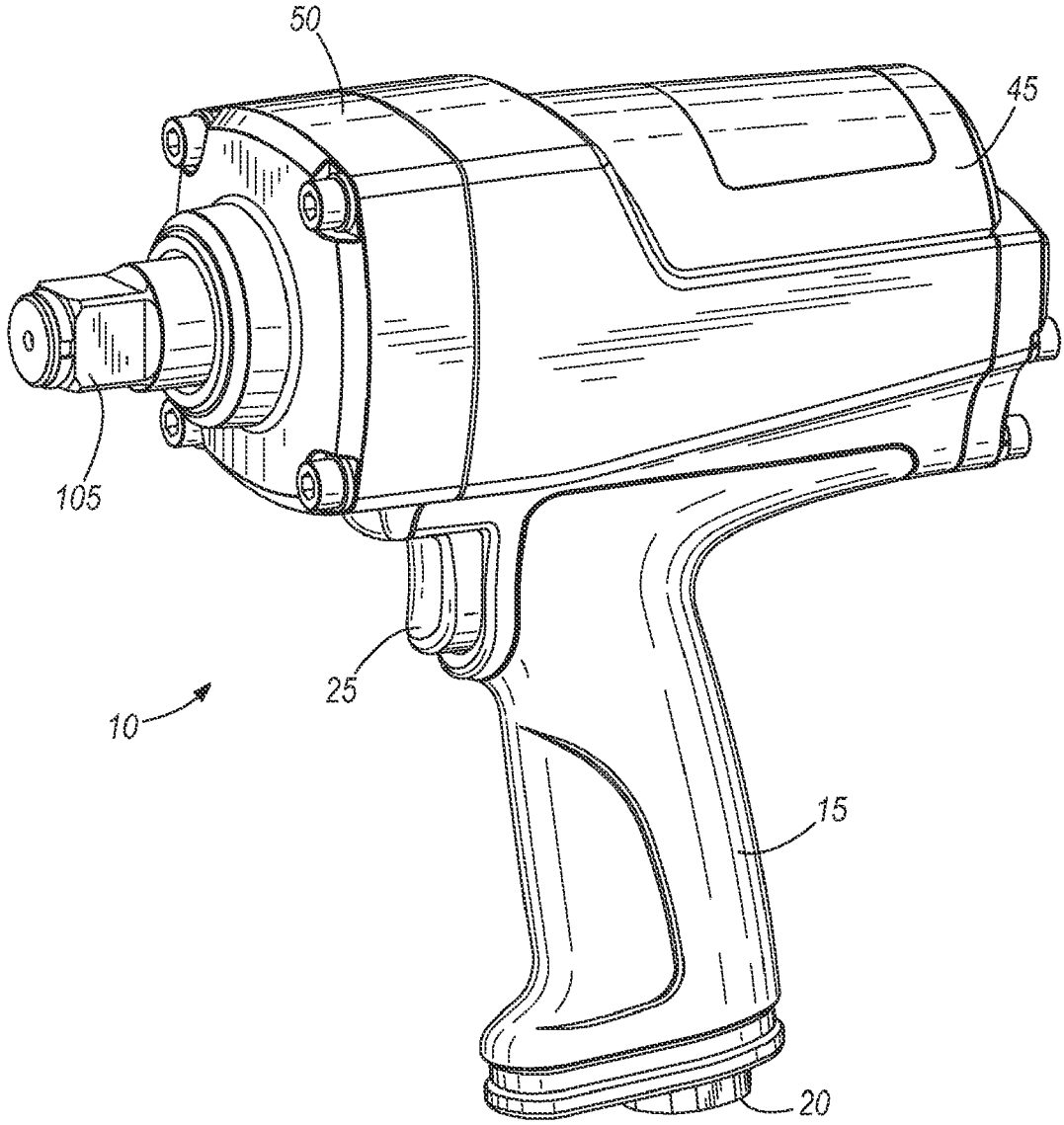
FIG. 1 is a perspective view of an air tool incorporating a swinging weight assembly embodying the present invention.
Figure 2:
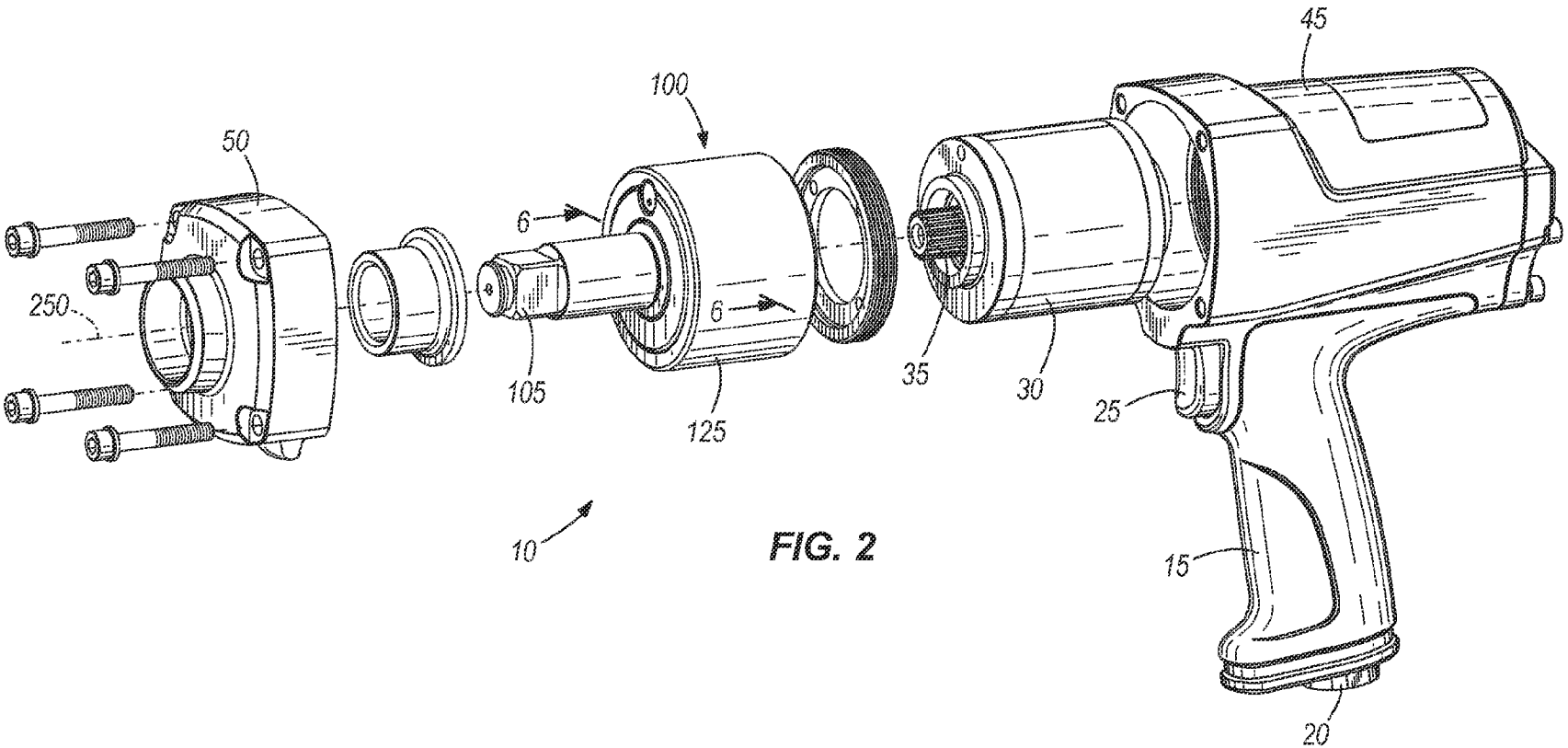
FIG. 2 is an exploded view of the air tool.

FIGS. 1 and 2 illustrate an example of an impact tool 10 in which a swinging weight assembly 100 of the present invention is incorporated. The illustrated impact tool 10 includes, in addition to the swinging weight assembly 100, a handle 15, a motive fluid fitting 20, a trigger 25, an air motor 30 having an output shaft 35, a rear tool case 45, and a front tool case 50.

A source of motive fluid, such as an air compressor, is connected to the motive fluid fitting 20 to provide a supply of motive fluid, such as compressed air, to the impact tool 10. An operator actuates the trigger 25 to regulate the flow of motive fluid to the air motor 30. The air motor 30 and swinging weight assembly 100 are supported within the tool case (comprising the rear tool case 45 and front tool case 50). The rear tool case 45 may be formed integrally with the handle 15, as illustrated, or may be a separate component. The flow of motive fluid to the air motor 30 drives rotation of the output shaft 35. The output shaft 35 includes splines that mesh with splines in the swinging weight assembly 100, such that rotation of the output shaft 35 drives operation of the swinging weight assembly 100. The swinging weight assembly 100 provides an attachment interface 105 (e.g., a square drive for a socket as illustrated) to which an appropriate attachment may be mounted. The swinging weight assembly 100 provides impact loading to the attachment to tighten or loosen a joint.

Figure 3:
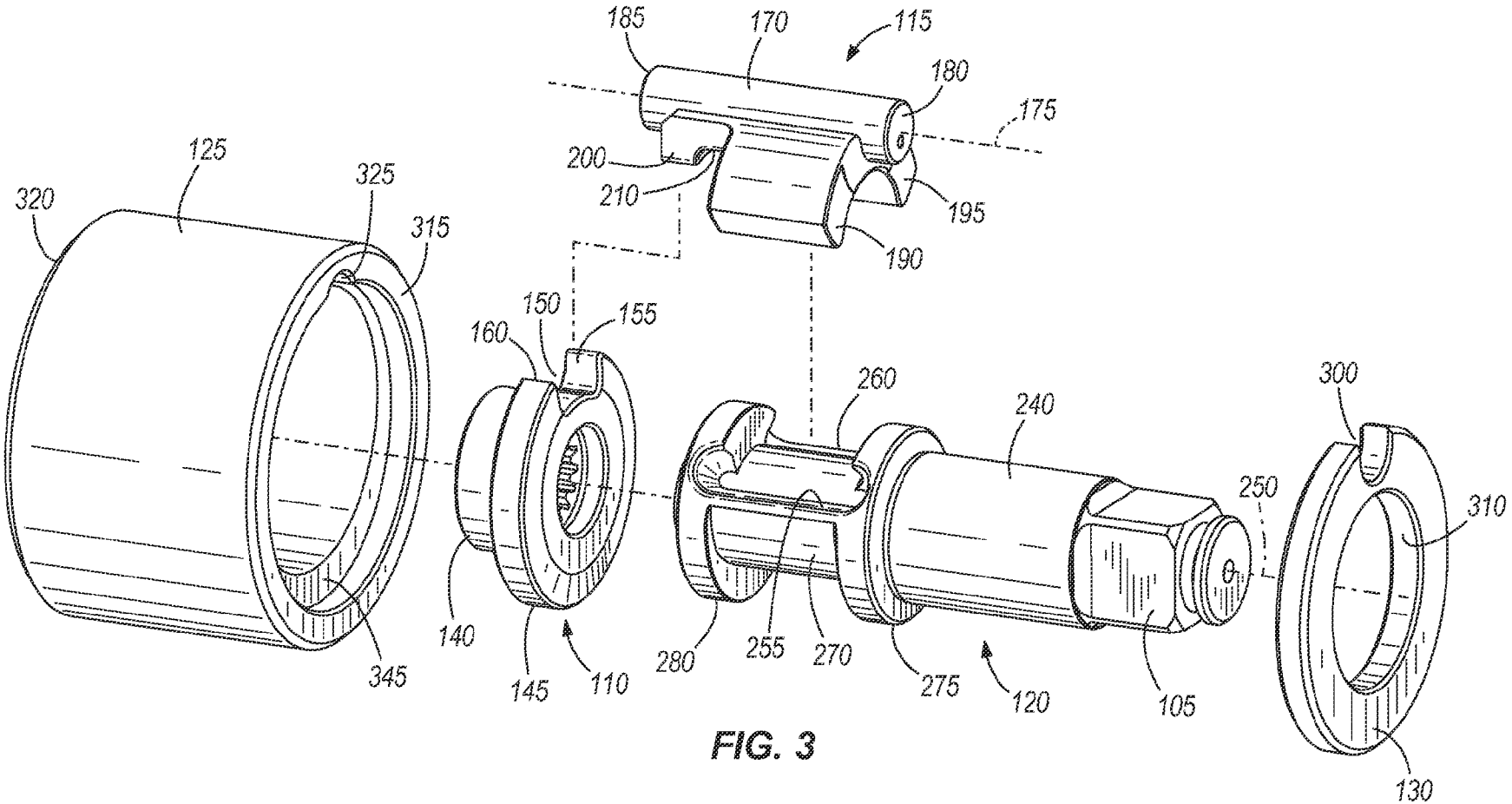
FIG. 3 is an exploded view of the swinging weight assembly from a first perspective.
Figure 4:
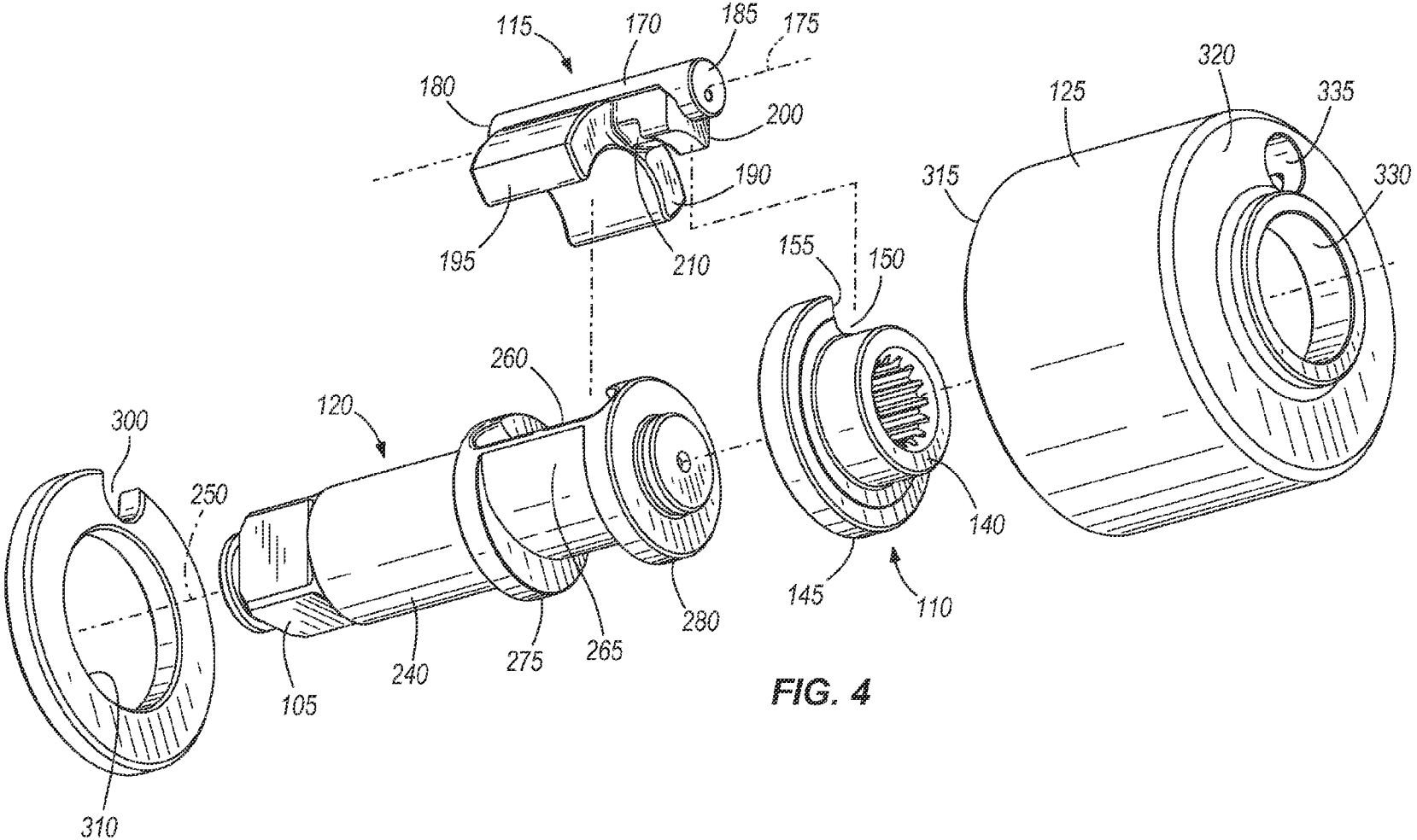
FIG. 4 is an exploded view of the swinging weight assembly from a second perspective.

Turning now to FIGS. 3 and 4, the swinging weight assembly 100 includes a cam piece or connector 110, a hammer 115, an anvil 120, a hammer frame 125, and a front plate 130.

The connector 110 includes a hub 140 and a rim 145. The hub 140 includes internal or female splines that mesh with external or male splines on the motor output shaft 35 to transmit torque from the output shaft 35 of the motor to the connector 110. The rim 145 of the connector 110 is generally ring-shaped and of larger diameter than the hub 140. The rim 145 includes a notch or cut-out 150 which provides a first disengaging cam surface 155 and a second disengaging cam surface 160.

The hammer 115 includes a pivot shaft 170 defining a hammer longitudinal axis or hammer axis 175 that is also the pivot axis of the hammer 115. The pivot shaft 170 includes a first end 180 and a second end 185 opposite the first end 180. The hammer 115 also includes a first hammer lug 190 (also called a first hammer lobe) and a second hammer lug 195 (also called a second hammer lobe) and a cam lug 200 (also called a cam lobe) that is spaced along the hammer axis 175 from the first hammer lug 190 and second hammer lug 195. Defined between the hammer lugs 190, 195 and the cam lug 200 is an arcuate recess 210.

The anvil 120 includes a shaft portion 240 that includes the attachment interface 105 discussed above. The shaft portion 240 defines an anvil longitudinal axis or anvil axis 250 that is also the axis of rotation of the anvil 120 during operation of the impact tool 10. The anvil 120 further includes a first jaw 255, a second jaw 260, a first engaging cam surface 265, a second engaging cam surface 270, a first flange 275, and a second flange 280. The first jaw 255 and second jaw 260 are generally parallel to each other and generally face each other. The first jaw 255 and second jaw 260 extend generally parallel to the anvil axis 250 and each includes first and second ends. The first flange 275 and second flange 280 are generally ring-shaped and are of larger diameter than the shaft portion 240. The first flange 275 is interconnected to the first ends of the first jaw 255 and second jaw 260 and the second flange 280 is interconnected to the second ends of the first jaw 255 and second jaw 260.

Figure 5:
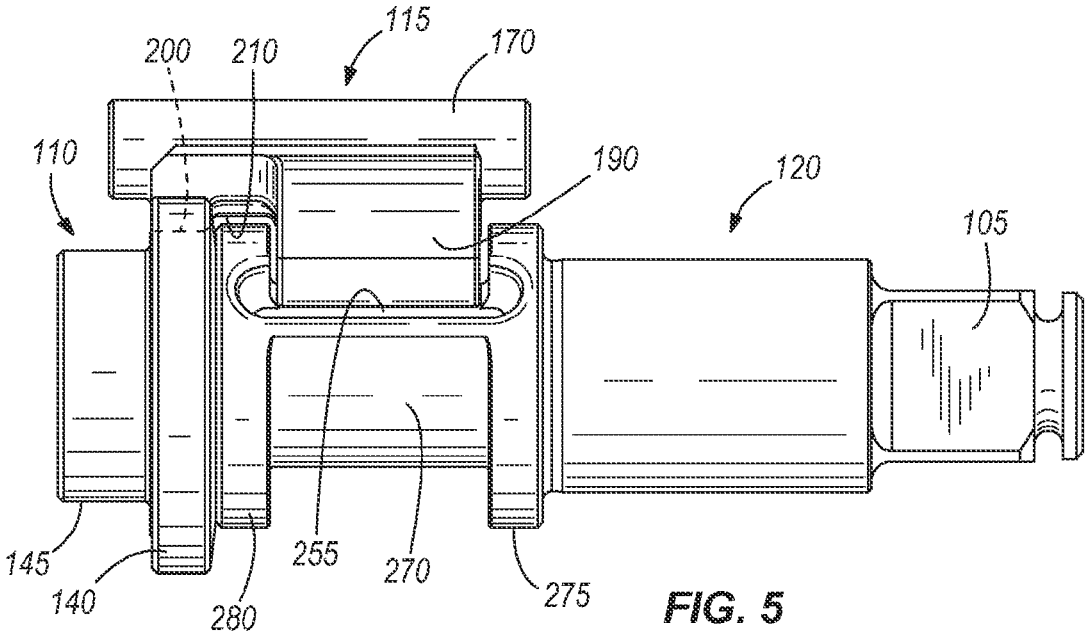
FIG. 5 is a side view of a subassembly of the swinging weight assembly.

FIG. 5 illustrates a subassembly of the swinging weight assembly 100, including the connector 110, the hammer 115, and the anvil 120. The cam lug 200 of the hammer 115 is received in the cut-out 150 in the rim 145 of the connector 110. A portion of the second flange 280 of the anvil 120 is received within the arcuate recess 210 between the cam lug 200 and the hammer lugs 190, 195. The hammer lugs 190 are between the first flange 275 and second flange 280 of the anvil 120.

Referring again to FIGS. 3 and 4, the front plate 130 is generally ring-shaped with a semi-circular groove 300 in its outer circumferential surface. The front plate 130 includes a central hole 310 through which the shaft portion 240 of the anvil 120 extends.

The hammer frame 125 includes a first frame end 315 which is generally open and receives the front plate 130 and a second frame end 320 opposite the first frame end 315 which is generally closed. A groove runs the length of the hammer frame 125, and forms at the first frame end 315 a semi-circular opening 325 that aligns with the semi-circular groove 300 in the front plate 130 to define a first hammer support. The second frame end 320 defines a connector support hole 330 and a second hammer support 335. The hub 140 of the connector 110 and the motor output shaft 35 extend through the connector support hole 330 to mate in a splined interconnection. When the front plate 130 is mounted to the first frame end 315, the first end 180 of the hammer pivot shaft 170 is received in the first hammer support (comprised of groove 300 and opening 325) and the second end 185 of the hammer pivot shaft 170 is received in the second hammer support 335. Because the hammer 115 creates an eccentric weight with respect to the motor output shaft 35 axis of rotation (which is collinear with the anvil axis 250), the hammer frame 125 is eccentrically weighted by means of additional material 345 diametrically opposed to hammer 115 to reduce or eliminate vibration during operation.

Once assembled, the connector 110 is coupled to the hammer 115 through the abutment of the first disengaging cam surface 155 or second disengaging cam surface 160 against the cam lug 200. The hammer 115 is pivotable about the hammer axis 175 with respect to the hammer frame 125 and front plate 130. As the connector 110 is rotated about the anvil axis 250 under the influence of rotation of the motor shaft 35, it causes the hammer 115 to orbit the anvil axis 250. The hammer 115 in turn causes the hammer frame 125 and front plate 130 to rotate about the anvil axis 250. In other words, the connector 110, hammer 115, hammer frame 125, and front plate 130 are coupled for rotation together under the influence of the motor output shaft 35. The anvil 120 is not continuously coupled to the hammer 115, but is rather subject to periodic impact loads from the hammer 115 to rotate the anvil 120 (and the joint to which the anvil 120 is coupled) about the anvil axis 250.

Referring now to FIGS. 6-11, a complete cycle of the swinging weight assembly 100 will be described. The illustrated assembly is symmetrical, such that it can operate in forward and reverse directions in which the anvil 120 is rotated under impact loading in clockwise and counterclockwise directions (as viewed from the rear of the impact tool 10) to tighten and loosen, respectively, standard right hand threaded joints (e.g., fasteners, nuts, etc.). For the sake of brevity, the cycle of operation below will be described with respect to clockwise rotation of the assembly to cause clockwise, tightening rotation of the anvil 120. It will be apparent to one of ordinary skill in the art that a description of the assembly working in the opposite direction (counterclockwise) will generally switch the functionality of components labeled as "first" and "second" with each other.

The cross-section view of FIGS. 6-11 is taken from a perspective looking from the front of the tool back toward the motor (see cross-section line 6-6 in FIG. 2) to most clearly illustrate the operation of the hammer lugs 190, 195 and cam lug 200. Consequently, although the cycle of operation illustrated in FIGS. 6-11 and described below rotates the hammer 115 and anvil 120 in the clockwise direction (conventionally speaking, taken from the back of the tool looking toward the front), the hammer 115 and anvil 120 rotate counterclockwise from the perspective of these figures. The arrows in FIGS. 6, 7, 9, and 11 indicate the direction of movement of the hammer 115.

Figure 6:
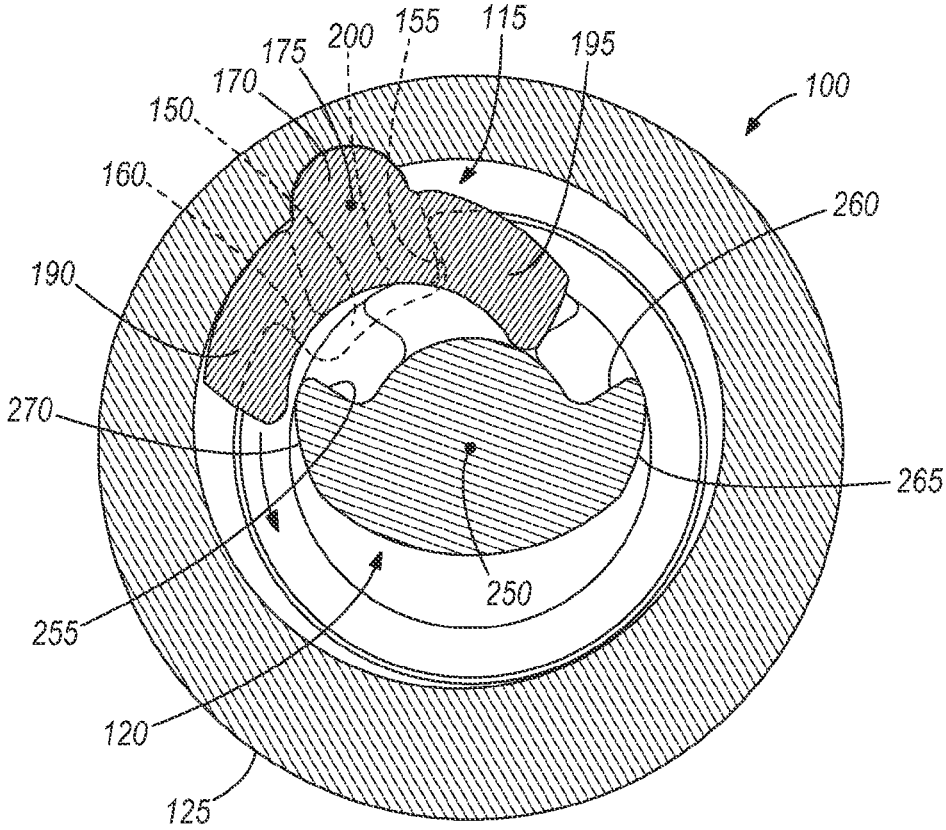
FIG. 6 is a cross-sectional view taken along line 6-6 in FIG. 2, illustrating the hammer clearing the impact jaw of the anvil.

In FIG. 6, the first hammer lug 190 is clearing or moving past the first jaw 255 of the anvil 120. In this illustration, the hammer 115 is pivoted into a disengaged position in which the first hammer lug 190 is pivoted up and the second hammer lug 195 is pivoted down ("up" in this context meaning radially away from the anvil axis 250 and "down" in this context meaning radially toward the anvil axis 250). The hammer 115 is pivoted into this disengaged position under the influence of the first disengaging cam surface 155 acting on the cam lug 200 to pivot the hammer 115 about the hammer axis 175. During the entire operation of the swinging weight assembly 100 in the forward direction, the cam lug 200 applies a camming force to the hammer 115 through the first disengaging cam surface 155, which biases the hammer 115 to pivot about the hammer axis 175 toward the disengaged position. Although the illustrated example only addresses forward operation of the swinging weight assembly 100, it is worth noting that in reverse operation of the assembly 100, the second disengaging cam surface 160 bears against the cam lug 200 to bias the hammer 115 into a second disengaged position in which the second hammer lug 195 is up and the first hammer lug 190 is down so the hammer 115 can clear the second jaw 260.

As the hammer 115 continues to orbit the anvil 120 in the clockwise direction as seen in FIG. 6, the second hammer lug 195 is moved into abutment with the first jaw 255, which causes the first hammer lug 190 to pivot down and the second hammer lug 195 to pivot up. The hammer 115 continues to move around the anvil 120 in this attitude until the first hammer lug 190 abuts and moves over the first engaging cam surface 265, which causes the first hammer lug 190 to pivot up and the second hammer lug 195 to pivot down. These pivoting steps are not illustrated.

Figure 7:
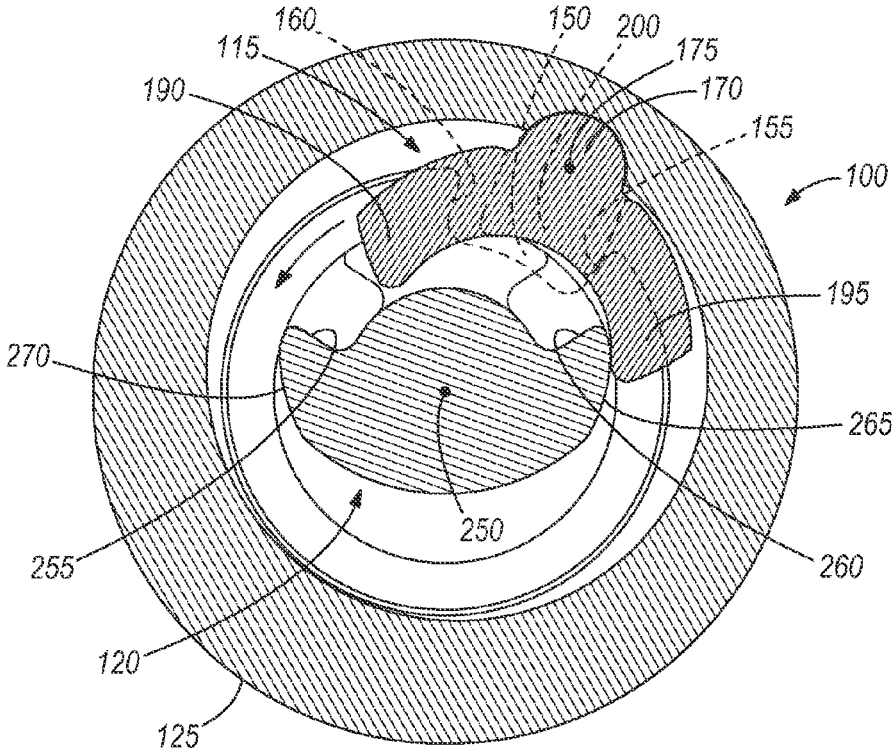
FIG. 7 is a cross-sectional view taken along line 6-6 in FIG. 2, illustrating the hammer being pivoted into an impact position.

Referring to FIG. 7, as the first hammer lug 190 clears the first engaging cam surface 265 and the second hammer lug 195 moves across the first engaging cam surface 265, the hammer 115 is pivoted into an engaged position in which the first hammer lug 190 is pivoted down about the hammer axis 175 and the second hammer lug 195 is pivoted up, as illustrated. When in the engaged position, the hammer 115 is ready to strike the first jaw 255 of the anvil 120. Having orbited entirely around the anvil 120, the hammer 115 has achieved sufficient speed to strike the first jaw 255 before the hammer 115 can pivot back to the disengaged position. In other words, the camming force of the first disengaging cam surface 155 acting on the cam lug 200 does not have time to pivot the hammer 115 into the disengaged position prior to impact of the first hammer lug 190 with the first jaw 255.

Figure 8:
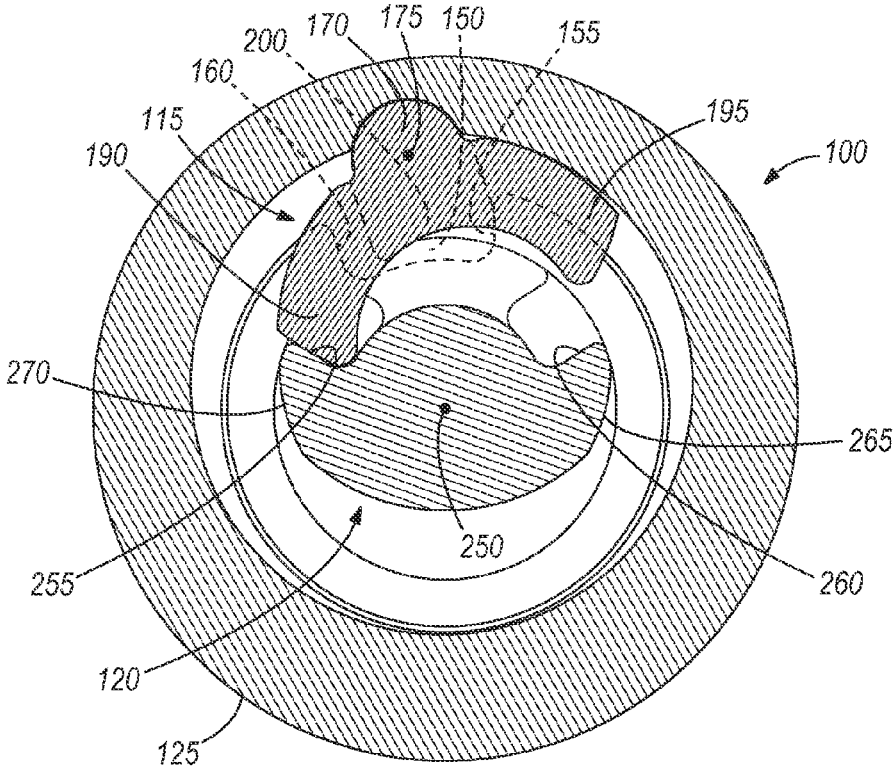
FIG. 8 is a cross-sectional view taken along line 6-6 in FIG. 2, illustrating the hammer impacting the anvil.
Figure 9:
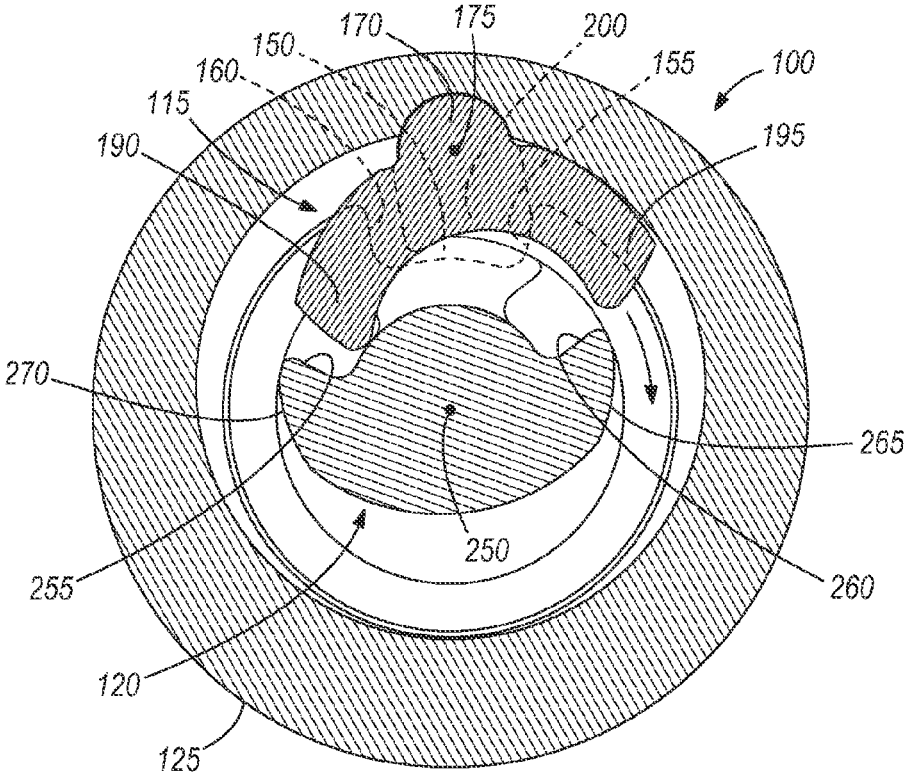
FIG. 9 is a cross-sectional view taken along line 6-6 in FIG. 2, illustrating the hammer rebounding after impact.

In FIG. 8, the first hammer lug 190 impacts the first jaw 255. As seen in FIG. 9, the impact causes the anvil 120 to rotate some amount and causes the hammer 115 to rebound. The amount of anvil 120 rotation and hammer 115 rebound depend on, among other factors, the stiffness of the joint to which the assembly is attached and the hardness of the materials from which the hammer 115 and anvil 120 are constructed. The hammer 115 continues to rebound, against the forward rotational torque of the motor shaft, which causes the motor to rotate backwards against the influence of the motive fluid.

Figure 10:
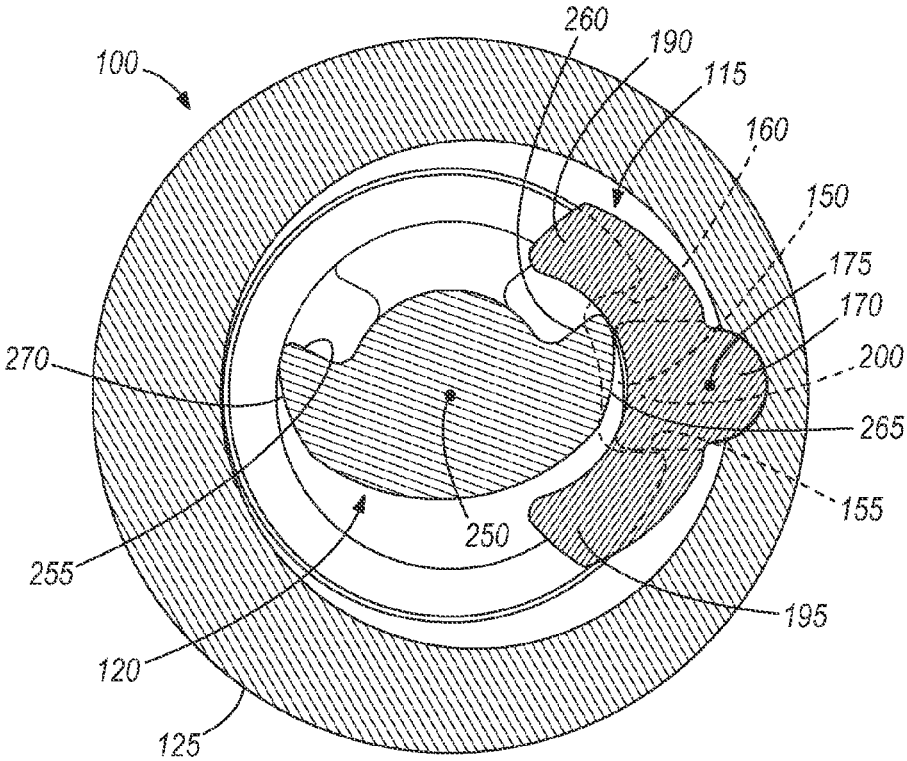
FIG. 10 is a cross-sectional view taken along line 6-6 in FIG. 2, illustrating the hammer at the end of the rebound portion of its operation cycle.
Figure 11:
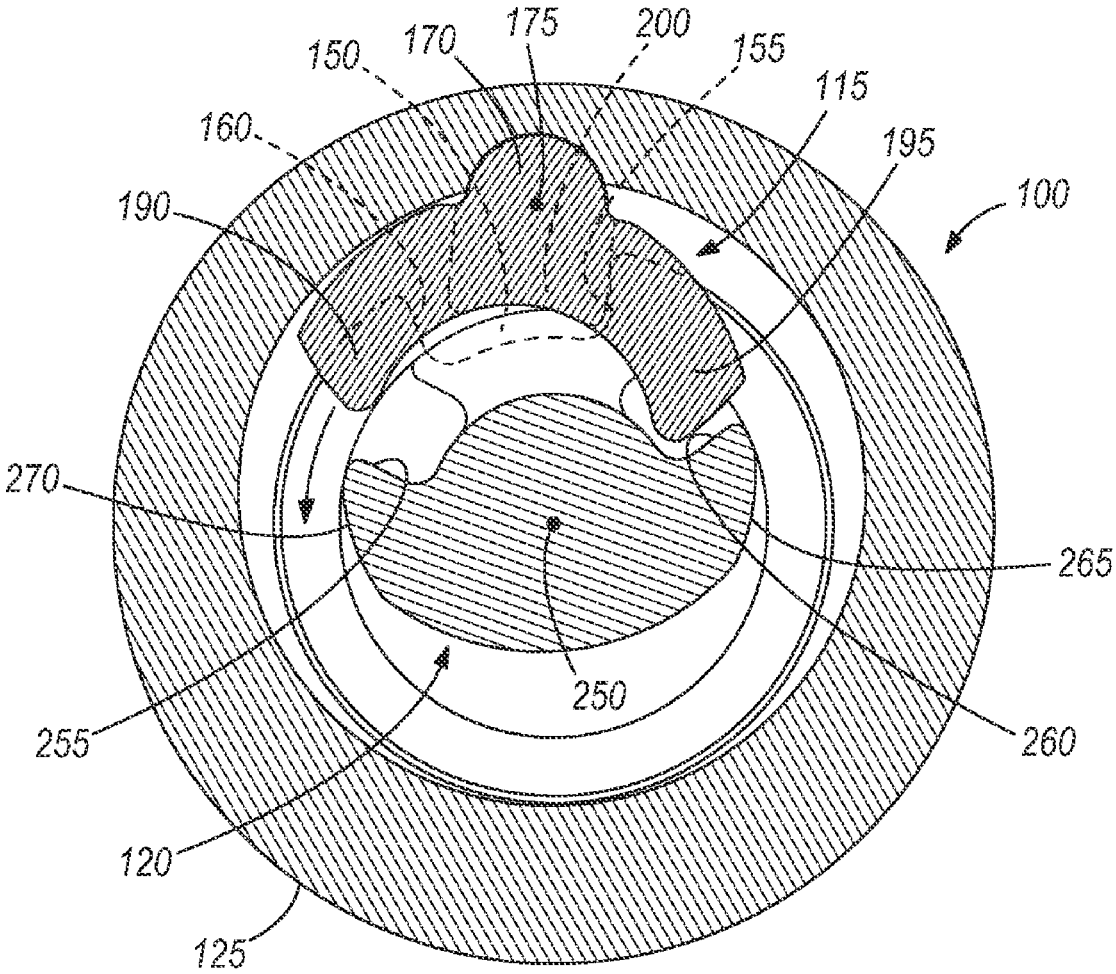
FIG. 11 is a cross-sectional view taken along line 6-6 in FIG. 2, illustrating the hammer pivoting into a clearance position.

FIG. 10 illustrates the position of the hammer 115 when the force of the motive fluid acting on the motor arrests the rebound of the hammer 115 and begins to again rotate the hammer 115 forward. Initial movement of the hammer 115 in the forward direction is relatively slow as momentum has not yet built up. The hammer 115 again moves over the first engaging cam surface 265 to again pivot into the engaged position (as in FIG. 7). With reference to FIG. 11, this time, however, the hammer 115 is moving slowly enough such that the action of the first disengaging cam surface 155 on the cam lug 200 causes the hammer 115 to pivot into the disengaged position after the second hammer lug 195 clears the first engaging cam surface 265 and the second jaw 260, but before the first hammer lug 190 strikes the first jaw 255. As a result, the first hammer lug 190 can clear the first jaw 255 of the anvil 120 (as seen in FIG. 6), thus completing the cycle of operation.

The time required for the hammer 115 to pivot into the disengaged position and avoid impact with the jaws 255, 260 may be termed the critical time, which would make a "critical speed" the speed at which the hammer travels to achieve the critical time between the trailing hammer lug (the second hammer lug 195 in the illustrated example) clearing the engaging cam surface (the first engaging cam surface 265 in the illustrated example) and the leading hammer lug (the first hammer lug 190 in the example above) striking the impact jaw (the first jaw 255 in the illustrated example). If the hammer 115 is moving at a speed below the critical speed, the hammer 115 will clear the impact jaw 255 or 260 and if the hammer is moving at a speed above the critical speed, the hammer 115 will strike the impact jaw 255 or 260.

The present invention disjoins the camming feature of the hammer 115 from the impact feature by separating the hammer lugs 190, 195 from the cam lug 200 with the arcuate recess 210. In other words, the present invention provides a hammer 115 in which the cam lug 200 is not integrally formed with the hammer lugs 190, 195. It is believed that the arcuate recess 210 distributes the impact loading of the hammer lugs 190, 195 into the material of the hammer 115 and reduces the reaction load between the cam lug 200 and the disengaging cam surfaces 155, 160. Additionally, the present invention reinforces the impact jaws 255, 260 with the flanges 275, 280 to increase cycles-to-failure for the jaws 255, 260 and the anvil. The flanges 275, 280 may also be referred to as reinforcing hubs. The separation of the hammer lugs 190, 195 from the cam lug 200 provides clearance (via the arcuate recess 210) for the second (rear) flange 280.

Because the present invention reduces root loads borne by the cam lug 200 and impact jaws 255, 260, a swinging weight mechanism constructed according to the present invention may be made with smaller, lighter designs having more favorable power to weight ratios. Although the illustrated embodiment includes both forward and reverse impact jaws 255, 260 and forward and reverse hammer lugs 190, 195, and with first and second flanges 275, 280, other embodiments may include only one of each of these features and still be within the scope of the present invention.

Thus, the invention provides, among other things, a swinging weight assembly including a reinforcing flange for the impact jaw of the anvil. Various features and advantages of the invention are set forth in the following claims.

We claim:

1. An impact mechanism comprising:

a hammer defining a hammer axis and including a hammer lug, a cam lug spaced from the hammer lug, and a recess between the hammer lug and the cam lug;

an anvil defining an anvil axis that is generally parallel to but non-collinear with the hammer axis, the anvil including a jaw extending substantially parallel to the anvil axis, an engaging cam surface, and a flange generally perpendicular to the anvil axis and interconnected with the jaw; and a connector adapted to mount to a motor output shaft and rotate in response to rotation of the motor output shaft, the connector including a disengaging cam surface bearing against the cam lug to cause the hammer to orbit the anvil in response to rotation of the connector;

wherein a portion of the flange is received within the recess of the hammer between the hammer lug and the cam lug for at least a portion of the orbital movement of the hammer about the anvil;

wherein the hammer is pivoted about the hammer axis into an engaged position in response to a portion of the hammer moving along the engaging cam surface of the anvil, the hammer lug striking the jaw of the anvil when the hammer lug is in the engaged position and the hammer is moving at a rate in excess of a critical speed, the hammer lug striking the jaw causing rotation of the anvil about the anvil axis; and wherein the hammer is pivoted about the hammer axis into a disengaged position prior to the hammer striking the jaw of the anvil in response to the disengaging surface of the connector bearing against the cam lug while the hammer is moving at a rate below a critical speed, such that the hammer lug moves past the jaw of the anvil.

2. The impact mechanism of claim 1, further comprising a frame supporting the hammer for pivotal movement between the engaged and disengaged positions; wherein the frame is rotatable about the anvil axis as the hammer orbits the anvil.

3. The impact mechanism of claim 2, further comprising a weight coupled to the frame substantially opposite the hammer, the weight operable to limit vibration of the impact mechanism during operation.

4. The impact mechanism of claim 1, wherein the hammer lug is a first hammer lug; wherein the hammer further includes a second hammer lug; wherein the jaw of the anvil is a first jaw and the engaging cam surface of the anvil is a first engaging cam surface; wherein the anvil further includes a second jaw and a second engaging cam surface; wherein movement of the second hammer lug along the first engaging cam surface causes the hammer to pivot into a first engaged position to strike the first jaw when the hammer orbits about the anvil axis in a first direction; and wherein movement of the first hammer lug along the second engaging cam surface causes the hammer to pivot into a second engaged position to strike the second jaw when the hammer orbits about the anvil axis in a second direction opposite the first direction.

5. The impact mechanism of claim 1, wherein the jaw of the anvil is a first jaw, the anvil further including a second jaw generally parallel to the first jaw; wherein the flange is interconnected to both the first and second jaws.

6. The impact mechanism of claim 1, wherein the jaw of the anvil includes first and second opposite ends; wherein the flange is a first flange that is interconnected with the first end of the anvil; and wherein the hammer further includes a second flange generally perpendicular to the anvil axis and interconnected with the second end of the jaw.

7. The impact mechanism of claim 1, wherein the jaw of the anvil is a first jaw, the anvil further including a second jaw generally parallel to the first jaw; wherein both the first jaw and the second jaw each include first and second opposite ends; and wherein the flange is a first flange interconnected with the first ends of the first and second jaws, the anvil further comprising a second flange generally parallel to the first flange and interconnected to the second ends of the first and second jaws.

8. The impact mechanism of claim 1, wherein the flange is generally ring shaped and is within the recess of the hammer during substantially an entire orbit of the hammer around the anvil.

9. The impact mechanism of claim 1, further comprising a reinforcing hub positioned on the anvil adjacent the jaw.

10. The impact mechanism of claim 9, wherein the reinforcing hub is inserted between the hammer lug and the cam lug, thereby permitting the hammer to rotate with respect to the anvil.

11. A method of rotating an output shaft of an impact mechanism, the method comprising:

orbiting a hammer about an anvil in a first rotational direction;

abutting a hammer lug against an anvil jaw when the hammer is rotating at a first speed;

rotating the anvil about an anvil axis in the first rotational direction in response to abutting the hammer against the anvil jaw;

rebounding the hammer lug in a second rotational direction, opposite the first rotational direction;

sliding the hammer lug over the anvil jaw when the hammer is rotating at a second speed, slower than the first speed;

orbiting the hammer about the anvil in the second rotational direction;

abutting a second hammer lug against a second anvil jaw when the hammer is rotating at a third speed;

rotating the anvil about the anvil axis in the second rotational direction in response to abutting the second hammer against the second anvil jaw;

rebounding the second hammer lug in the first rotational direction, opposite the second rotational direction; and sliding the second hammer lug over the second anvil jaw when the hammer is rotating at a fourth speed, slower than the third speed.

12. The method of claim 11, further comprising coupling the hammer to a frame for rotation with the frame about the anvil axis.

13. The method of claim 12, further comprising rotating the hammer with respect to the frame about a hammer axis, spaced from the anvil axis.

14. The method of claim 11, further comprising orbiting the hammer about the anvil in the first rotational direction and abutting the hammer lug against the anvil jaw after sliding the hammer lug over the anvil jaw.

15. The method of claim 11, further comprising coupling the hammer and the anvil to the output shaft to rotate the output shaft in response to rotation of the hammer and the anvil.

16. The method of claim 11, further comprising rotating the hammer with the anvil about the anvil axis and rotating the hammer with respect to the anvil about the hammer axis.

17. The method of claim 11, further comprising damping vibration of the impact mechanism by positioning a mass opposite the hammer and rotating the mass about the anvil axis with the hammer.

18. The method of claim 11, further comprising supporting the anvil jaw with a cam lug and rotating the cam lug about the anvil axis.

19. The method of claim 18, further comprising inserting the cam lug into a slot in a connector to couple the connector to the hammer for rotation with the hammer.

20. A method of rotating an output shaft of an impact mechanism, the method comprising:

orbiting a hammer about an anvil in a first rotational direction;

abutting a hammer lug against an anvil jaw when the hammer is rotating at a first speed;

rotating the anvil about an anvil axis in the first rotational direction in response to abutting the hammer against the anvil jaw;

rebounding the hammer lug in a second rotational direction, opposite the first rotational direction;

sliding the hammer lug over the anvil jaw when the hammer is rotating at a second speed, slower than the first speed; and damping vibration of the impact mechanism by positioning a mass opposite the hammer and rotating the mass about the anvil axis with the hammer.

* * * * *